US010913074B2

(12) United States Patent
Kwon et al.

(10) Patent No.: US 10,913,074 B2
(45) Date of Patent: Feb. 9, 2021

(54) ELECTRIC DUST COLLECTOR

(71) Applicant: LG ELECTRONICS INC., Seoul (KR)

(72) Inventors: Jayoung Kwon, Seoul (KR); Hyekyung Jeon, Seoul (KR); Junseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 326 days.

(21) Appl. No.: 15/963,376

(22) Filed: Apr. 26, 2018

(65) Prior Publication Data

US 2018/0311681 A1 Nov. 1, 2018

(30) Foreign Application Priority Data

Apr. 27, 2017 (KR) ..... 10-2017-0054459

(51) Int. Cl.

| | |
|---|---|
| ***B03C 3/64*** | (2006.01) |
| ***B03C 3/08*** | (2006.01) |
| ***B03C 3/47*** | (2006.01) |
| ***B03C 3/12*** | (2006.01) |
| ***B03C 3/41*** | (2006.01) |

(52) U.S. Cl.

CPC ..... *B03C 3/64* (2013.01); *B03C 3/08* (2013.01); *B03C 3/12* (2013.01); *B03C 3/41* (2013.01); *B03C 3/47* (2013.01); *B03C 2201/04* (2013.01)

(58) Field of Classification Search

CPC combination set(s) only.
See application file for complete search history.

(56) References Cited

U.S. PATENT DOCUMENTS 5,466,279 A * 11/1995 Hattori ..... B03C 3/12 96/69
5,643,502 A * 7/1997 Nahass ..... H01B 1/24 252/511
8,617,298 B2 * 12/2013 Nakahara ..... B03C 3/08 96/69
9,457,118 B2 * 10/2016 Ota ..... B03C 3/09

(Continued)

FOREIGN PATENT DOCUMENTS

CN 1141085 1/1997
CN 1385471 12/2002

(Continued)

OTHER PUBLICATIONS

Maryniak, William A. et al.; © 2013; www.trekinc.com; Surface Resistivity and Surface Resistance Measurements; No. 1005, p. 1. (Year: 2013).*

(Continued)

*Primary Examiner* — Christopher P Jones
*Assistant Examiner* — Sonji Turner
(74) *Attorney, Agent, or Firm* — Ked & Associates, LLP

(57) ABSTRACT

The present disclosure relates to an electric dust collector for generating an electric field by a high voltage electrode formed of a polymer. An electric dust collector according to the present disclosure includes a high voltage electrode to which a high voltage is applied, composed of a thermoplastic polymer and an inherently dissipative polymer, and a ground electrode to be grounded to generate the electric field with the high voltage electrode.

8 Claims, 3 Drawing Sheets

(56) References Cited

U.S. PATENT DOCUMENTS

| | | | | |
|---|---|---|---|---|
| 2003/0005824 | A1* | 1/2003 | Katou | B03C 3/155 96/35 |
| 2008/0191176 | A1* | 8/2008 | Tobori | C08J 3/226 252/511 |
| 2012/0312170 | A1* | 12/2012 | Noh | B03C 3/12 96/86 |
| 2015/0377500 | A1* | 12/2015 | Lee | B03C 3/02 96/77 |
| 2016/0243559 | A1* | 8/2016 | Kim | B03C 3/41 |
| 2017/0120182 | A1* | 5/2017 | Kim | B03C 3/02 |
| 2017/0120256 | A1* | 5/2017 | Jeon | B03C 3/45 |
| 2017/0120257 | A1* | 5/2017 | Lee | B03C 3/86 |
| 2017/0203305 | A1* | 7/2017 | Lee | B03C 3/025 |

FOREIGN PATENT DOCUMENTS

| | | | | |
|---|---|---|---|---|
| CN | 1849366 | | 10/2006 | |
| CN | 1900162 | | 1/2007 | |
| CN | 101875779 | | 11/2010 | |
| CN | 102884119 | | 1/2013 | |
| CN | 103537374 | | 1/2014 | |
| CN | 105682770 | | 6/2016 | |
| JP | 8 71451 | * | 3/1996 | B03C 3/08 |
| JP | 2008-264623 | | 11/2008 | |
| JP | 2008-284515 | | 11/2008 | |
| JP | 2008284515 | A * | 11/2008 | |
| JP | 2009095799 | A * | 5/2009 | |
| JP | 2011-088059 | | 5/2011 | |
| KR | 10-1999-0045462 | | 6/1999 | |
| WO | WO 2008/010137 | | 1/2008 | |
| WO | WO 2011/016536 | | 2/2011 | |
| WO | WO-2017091922 | A1 * | 6/2017 | B03C 3/08 |

OTHER PUBLICATIONS

German Office Action dated Jan. 9, 2019 issued in DE Application No. 102018206470.9.

Chinese Office Action dated May 31, 2019 issued in CN Application No. 201810390706.1.

Korean Office Action dated Jun. 13, 2019 issued in KR Application No. 10-2017-0054459.

Korean Office Action dated Aug. 8, 2018 issued in KR Application No. 10-2017-0054459.

Indian Office Action dated May 29, 2020 issued in IN Application No. 201814015866.

* cited by examiner

ELECTRIC DUST COLLECTOR

CROSS-REFERENCE TO RELATED APPLICATION

This application claims priority under 35 U.S.C. § 119 to Korean Application No. 10-2017-0054459, filed on Apr. 27, 2017, whose entire disclosure is hereby incorporated by reference.

BACKGROUND

1. Field

The present disclosure relates to an electric dust collector, and more specifically, to an electric dust collector that generates an electric field using a high voltage electrode formed of a polymer.

2. Background

An electric dust collector is a device mounted on or otherwise included in an air conditioner, air purifier, or other device to collect particles suspended in air. The electric dust collector may charge the suspected particles and may collect the charge particles from the air.

In certain examples, the electric dust collector may include an electrification unit that discharges energy to charge the particles, and a dust collection unit which generates an electric field to move and collect the charged particle by an electrostatic force. While air passes through the electrification unit and dust collection unit, the particles within the air are charged by the electrification unit, and then, the charged particle are collected by the dust collection unit.

The dust collection unit of the electric dust collector may include electrodes which are spaced apart and charged to generate the electric field to collect the charged particles. The electrodes of the dust collection unit of a convention electric dust collector may be formed of a metal material, but the metallic dust collection unit tends to be relatively heavy in weight, produce sparks, and difficult to form through molding.

Korean Patent Application Publication No. 10-1999-0045462 (published on Jun. 25, 1999) provides a dust collection unit having high-voltage electrodes that may be formed of a semi-insulating resin containing a hygroscopic resin. When a volume specific resistance is adjusted only by the hygroscopic resin, a low resistance value typically cannot be obtained, and the dust collecting efficiency is decreased.

Japanese Patent Application Publication No. 2011-88059 (published on May 6, 2011) teaches that a conductive material, such as a metal oxide, may be mixed with the base resin. However, as described in this reference, there is a possibility of occurrence of sparks due to pinholes that are formed in this combination of materials.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements, and wherein.

DETAILED DESCRIPTION

Advantages, features and demonstration methods of the present disclosure will be clarified through various embodiments described in more detail below with reference to the accompanying drawings. The disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims. Wherever possible, the same reference numbers will be used throughout the specification to refer to the same or like parts.

Figure 1:
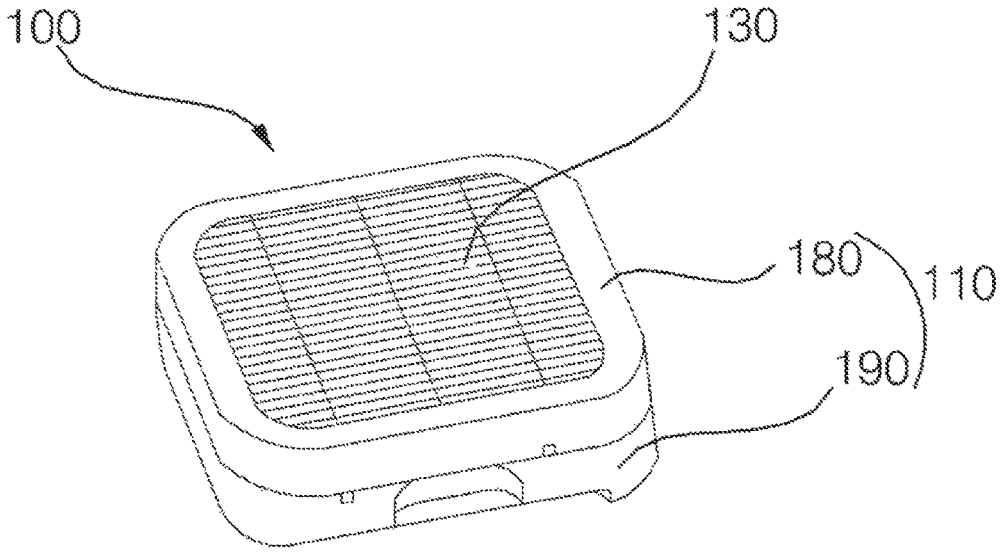
FIG. 1 is a perspective view illustrating an electric dust collector according to an embodiment of the present disclosure.
Figure 2:
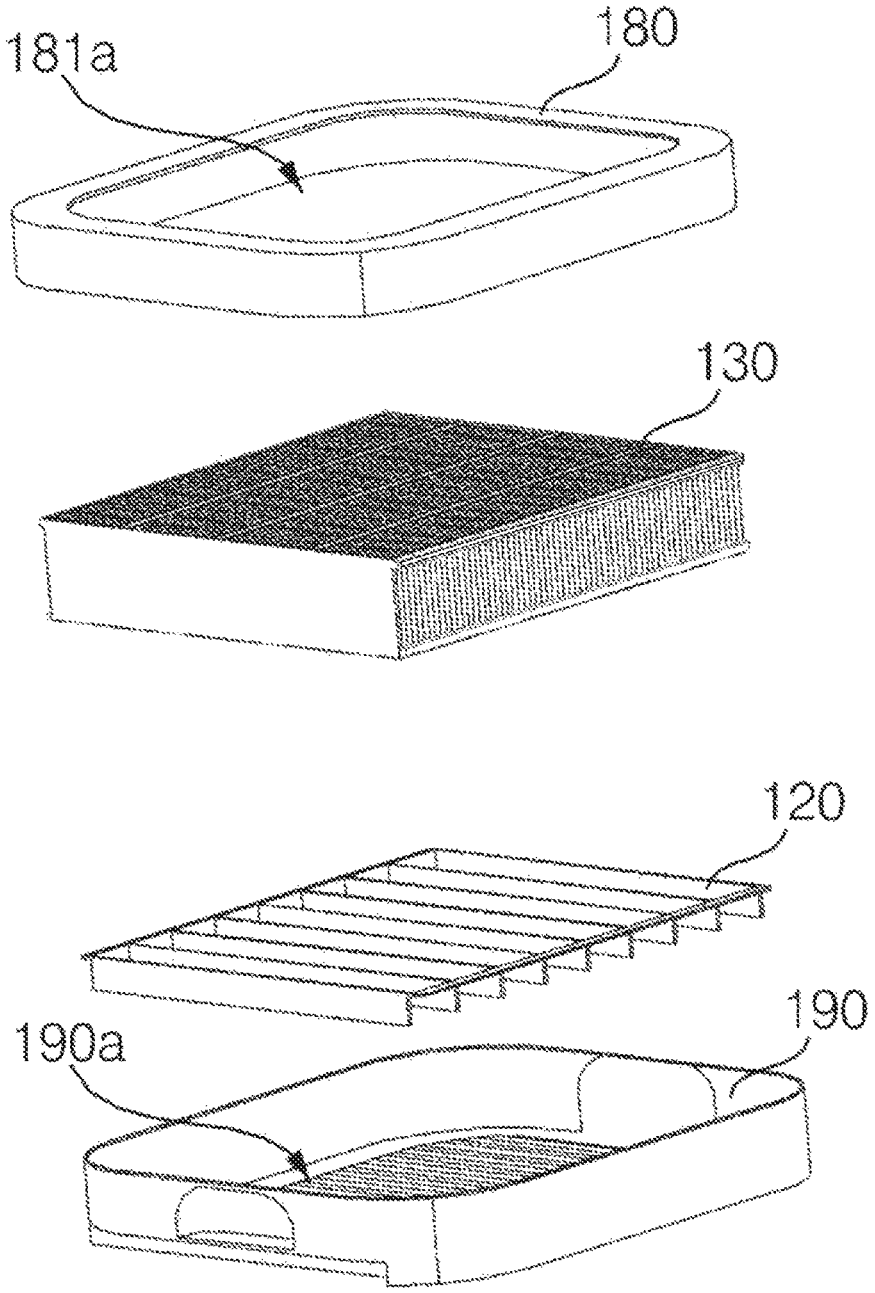
FIG. 2 is an exploded perspective view illustrating an electric dust collector according to an embodiment of the present disclosure.

Hereinafter, an electric dust collector 100 according to some embodiments will be described with reference to the accompanying drawings. FIG. 1 is a perspective view illustrating the electric dust collector 100, and FIG. 2 is an exploded perspective view illustrating the electric dust collector 100 according to certain embodiments of the present disclosure.

The electric dust collector 100 according to an embodiment of the present disclosure may include a case 110 forming an appearance of the electric dust collector 100; an electrification unit (or electrifier) 120 which is accommodated in the case 110 and electrifies a suspended particle within an area; and a dust collection unit (or dust collector) 130 which is accommodated in the case 110 and collects the particle charged by the electrification unit 120.

The case 110 may be configured to form an appearance of the electric dust collector 1. The case 110 may also form an internal space to receive and space apart the electrification unit 120 and the dust collection unit 130. The case 110 may have an inlet hole 190*a* and an outlet hole 181*a* so that outside air can flow, respectively, into and out of the internal space formed in the case 110. Air flowed into through the inlet hole 190*a* of the case 110 passes through the electrification unit 120 and the dust collection unit 130 sequentially, and then flows out of the case 110 through the outlet hole 181*a*.

The case 110 may include an electrification unit case (or inlet case) 190 accommodating the electrification unit 120, and a dust collection unit case (or outlet case) 180 accommodating the dust collection unit 130. The electrification unit 120 may be sized, shaped, or otherwise configured to be mounted inside the electrification unit case 190. The electrification unit case 190 may be configured to have at least one inlet hole 190*a* through which air flows into the electric dust collector 100. Similarly, the dust collection unit 130 maybe sized, shaped, or otherwise configured to be mounted inside dust collection unit case 180. The dust collection unit case 180 may be configured to have at least one outlet hole 181*a* through which air flows out of the electric dust collector 100. In certain examples, the electrification unit case 190 and the dust collection unit case 180 may be coupled to each other, or the electrification unit case 190 and the dust collection unit case 180 may be coupled to an intermediate component (not shown).

The electrification unit 120 may discharge energy to electrify suspended particle within an area, such as a space within the electrification unit case 190. The electrification unit 120 may include wire electrodes to which a high voltage is applied, and a plurality of opposite electrode plates, which are provided apart from respective ones of the wire electrodes. When a high voltage is applied to the wire electrodes of the electrification unit 120, a corona discharge may be generated between the wire electrodes and the opposite electrode plates, and as a result, molecules within the air may be ionized. The ions generated in the electrification unit 120 may electrify suspended particle within the area.

The electrification unit 120 may be provided inside the electrification unit case 190 such that the electrification unit 120 corresponds to the inlet hole 190*a* of the electrification unit case 190. The electrification unit 120 may be configured to be mounted inside the electrification unit case 190. The electrification unit 120 may be provided before the dust collection unit 130 relative to the flow of the air inside the case 110. In one configuration, the electrification unit 120 may be provided apart from the dust collection unit 130 such that they do not contact each other. The electrification unit 120 may be connected to a high voltage source to receive the high voltage that is applied to charge the suspended particles.

The dust collection unit 130 may be configured to generate an electric field to collect the charged particles. The dust collection unit 130 may be configured to collect the charged particles by an electrostatic force between the charge particle and the electric field. The dust collection unit 130 may be configured to be mounted inside dust collection unit case 180. The dust collection unit 130 may be configured to be mounted inside the case 110 such that the dust collection unit 130 corresponds to the outlet hole 181*a* of the dust collection unit case 180. The dust collection unit 130 may be provided downstream of the electrification unit 120 relative to the flow of the air inside the case 110. The dust collection unit 130 may be connected to a high voltage source applying a high voltage and to an electrical ground.

Figure 3:
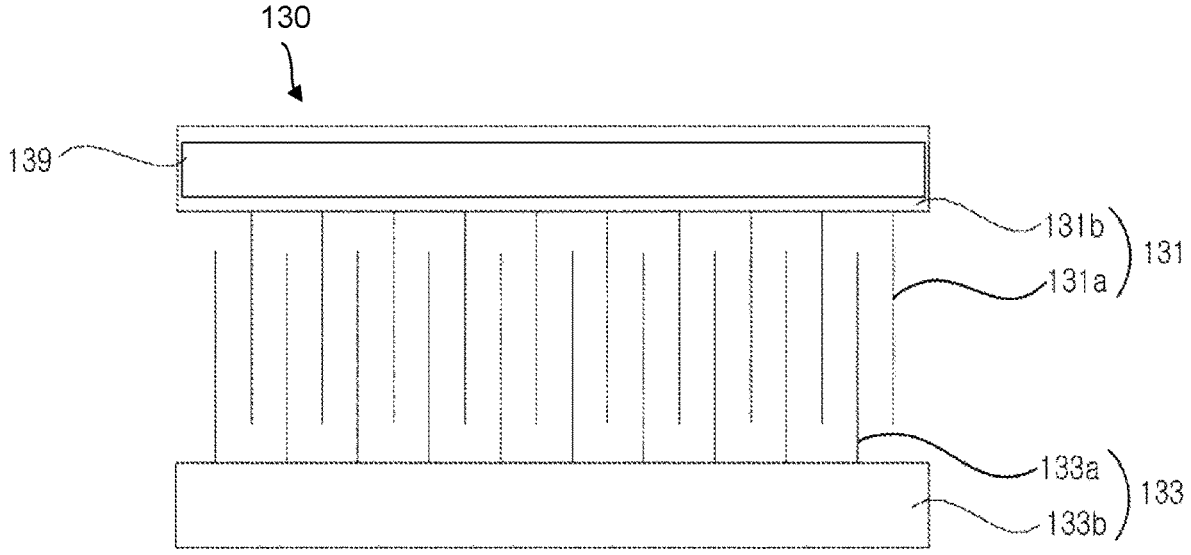
FIG. 3 is a schematic view illustrating a dust collection unit of the electric dust collector according to an embodiment of the present disclosure.

FIG. 3 is a schematic view illustrating a dust collection unit 130 of the electric dust collector 100 according to an embodiment of the present disclosure. The dust collection unit 130 according to an embodiment of the present disclosure may include a high voltage electrode (or first electrode) 131 to which a high voltage is applied, a ground electrode (or second electrode) 133 which is grounded and generates an electric field with the high voltage electrode 131, and a high voltage terminal 139 that applies a high voltage to the high voltage electrode 131. As described below, the high voltage electrode 131 may be formed of a thermoplastic polymer and an inherently dissipative polymer (IDP).

The high voltage electrode 131 may include of a plurality of high voltage plates 131*a* which may be each formed in a plate shape and may be arranged substantially in parallel such that the high voltage plates 131*a* do not contact each other. The high voltage electrode 131 may further include a high voltage rib 131*b* which connects the plurality of high voltage plates 131*a*. In one example, the plurality of high voltage plates 131*a* may be integrally formed with the high voltage rib 131*b*.

The ground electrode 133 may include a plurality of ground plates 133*a* which may be each formed in a plate shape and may be arranged substantially in parallel such that the plurality of ground plates 133*a* do not contact each other. The ground electrode 133 may further include a ground rib 133*b* which connects the plurality of the ground plates 133*a*. The plurality of ground plates 133*a* may be integrally formed with the ground rib 133*b*.

The high voltage terminal 139 may be substantially formed of a metal material and may be electrically connected to an external high voltage power source. In a preferred embodiment, the high voltage terminal 139 may be tightly coupled to the high voltage rib 131*b* of the high voltage electrode 131 to reduce resistance between the high voltage terminal 139 and the high voltage rib 131*b*.

Each of the plurality of high voltage plates 131*a* may be provided between a corresponding pair of the plurality of ground plates 133*a*. For example, the plurality of high voltage plates 131*a* of the high voltage electrode 131 and the plurality of ground plates 133*a* of the ground electrode 133 may be arranged at regular intervals, and the plurality of high voltage plates 131*a* may be staggered relative to the plurality of ground plates 133*a*. Each of the plurality of high voltage plates 131*a* may generate an electric field with each of the plurality of ground electrodes 133*a* which are provided between the plurality of high voltage plates 131*a*.

In accordance with an embodiment, the high voltage electrode 131 may be formed of semiconductive Live polymer having a surface resistivity of $10^9$ Ω/sq to $10^{12}$ Ω/sq and having both hygroscopicity and conductivity. The high voltage electrode 131 may be formed by mixing an inherently dissipative polymer with a thermoplastic polymer. The high voltage electrode 131 may be configured to have a surface resistivity in the range of $10^9$ Ω/sq to $10^{12}$ Ω/sq by adjusting the type and amount of the inherently dissipative polymer.

The thermoplastic polymer may include one or more of an acrylonitrile butadiene styrene (ABS), polyethylene, polystyrene, polyvinyl chloride, or the like. In accordance with one embodiment, the thermoplastic polymer is an ABS that has relatively high heat resistance and impact resistance, is relatively easy to mold, and has good compatibility with the inherently dissipative polymer.

The inherently dissipative polymer may be mixed with the thermoplastic polymer to provide hygroscopicity and conductivity and to adjust a surface resistivity, as desired. Generally, an inherently dissipative agent may be used to adjust the surface resistivity in order to prevent static electricity generated in a polymer, such as a plastic. In accordance with an embodiment, an inherently dissipative polymer corresponding to a high molecular weight inherently dissipative agent may be used to improve compatibility and to prevent deterioration of physical properties. Thereby, certain configuration discussed herein may allow mechanical strength, hygroscopicity and conductivity to be secured, sparking to be prevented, and the surface resistivity to be adjusted, as described desired.

In one example, the inherently dissipative polymer used in the high voltage electrode 131 may be a polyamide 6 (PA6), polypropylene, ABS, or the like. Table 1 shows performance results for these different types of inherently dissipative polymer. In this example, ABS is used as the thermoplastic polymer.

TABLE 1

| Type of inherently dissipative polymer | Surface resistance (Ω/sq) | Compatibility | Spark occurrence yes/no |
|---|---|---|---|
| PA6 | $10^{9-12}$ | Yes | Yes |
| Polypropylene | $10^{9-12}$ | Yes | No |
| ABS | $10^{9-12}$ | No | No |

As summarized in the results in Table 1, use of any of PA6, polypropylene, or ABS as the inherently dissipative polymer may achieve similar surface resistivity levels, but using the polyamide 6 (PA6) as an inherently dissipative polymer further results in no sparking occurring and securing compatibility.

Table 2 shows performance results according to using different concentrations of the inherently dissipative polymer. In this experiment, the ABS and polyamide 6 (PA6) are used as the thermoplastic polymer and the inherently dissipative polymer, respectively. In Table 2, the dust collecting efficiency corresponds to a ratio of the number of particle reduced after passing through the electric dust collector 100 to the number of particle within the air before passing through the electric dust collector 100 with an applied voltage of 6 kV and a wind speed of 1 m/s

TABLE 2

| Content of the inherently dissipative polymer (weight %) | Surface resistance (Ω/sq) | Spark occurrence yes/no | Leakage current (μA) | Dust collecting efficiency (%) |
|---|---|---|---|---|
| <10 | $10^{10-11}$ | Yes | 0 | 80~90 |
| 10~20 | $10^{10-11}$ | Yes | 0 | 90~95 |
| 20~30 | $10^{9}$ | Yes | 10~30 | 95~99 |
| 30~40 | $10^{8}$ | No | >30 | 95~99 |

As shown in Table 2, when the inherently dissipative polymer of the polyamide 6 (PA6) is contained in an amount of more than 30 wt %, sparking may occur the surface resistivity may be lower than or equals to $10^8$ Ω/sq, and a leakage current may be has excessively generated. When the inherently dissipative polymer of the polyamide 6 (PA6) is contained in an amount of 20 to 30 wt %, the dust collecting efficiency may be relatively high, but a leakage current may be generated. When the inherently dissipative polymer of the polyamide 6 (PA6) is contained in an amount of less than 10% by weight, the dust collecting efficiency may be lowered.

As further shown in Table 2, when the inherently dissipative polymer of the polyamide 6 (PA6) is contained in an amount of 10 to 20 wt %, the surface resistivity is $10^{10}$ Ω/sq to $10^{11}$ Ω/sq without the occurrence of a spark or a leakage current, and the dust collecting efficiency is also relatively high. Therefore, in one configuration, the high voltage electrode 131 may contains 10 to 20 wt % of the inherently dissipative polymer of the polyamide 6 (PA6) and, thus, may also contain 80 to 90 wt % of the thermoplastic polymer of the ABS, as well as other impurities.

In one configuration, the ground electrode 133 may be formed of a substantially same material as the high voltage electrode 131. In another example, the ground electrode 133 may be formed by mixing an absorptive polymer, a conductive material, or an inherently dissipative polymer in the thermoplastic polymer so that the surface resistivity is less than or equals to $10^9$ Ω/sq.

Aspects of the present disclosure provide an electric dust collector including a high voltage electrode formed of a polymer that has a low resistance value and is prevented from sparking. The present disclosure is not limited to the above-mentioned aspects, and other aspects not mentioned can be clearly appreciated by those skilled in the art from the foregoing description.

To provide these aspects, an electric dust collector according to an embodiment of the present disclosure may be configured to have a dust collection unit including a high voltage electrode to which a high voltage is applied and which is composed of a thermoplastic polymer and an inherently dissipative polymer, and a ground electrode which is grounded and generates an electric field with the high voltage electrode. Thus, the dust collection unit according to this embodiment may be formed of the polymer. The specific configurations, features according to some embodiments of the present disclosure will be described or illustrated in detailed description and drawings.

The electric dust collector according to the present disclosure has one or more effects as follows. First, the electric dust collector according to the present disclosure may use a high voltage electrode which is composed of an inherently dissipative polymer and a thermoplastic polymer, and thus has the advantage that no sparks occur. Second, the high voltage electrode may have hygroscopicity and conductivity that are obtained by containing the inherently dissipative polymer in the thermoplastic polymer. Third, the high voltage electrode has an excellent compatibility and a high mechanical strength, by mixing the inherently dissipative polymer which is a polyamide 6 with the thermoplastic polymer which is an ABS (acrylonitrile butadiene styrene) Fourth, the high voltage electrode may eliminate a leakage current and to secure the dust collecting efficiency by mixing the inherently dissipative polymer which is a polyamide 6 with the thermoplastic polymer which is the ABS at an appropriate ratio. The present disclosure is not limited to the above-mentioned effects or features, and other effects or features not mentioned can be clearly appreciated by those skilled in the art from the claim.

It will be understood by those skilled in the art that various changes in form and details may be made therein without departing from the spirit and scope of the disclosure as defined by the appended claims. Thus, it is intended that the present disclosure covers the modifications and variations of this disclosure provided they come within the scope of the appended claims and their equivalents. The scope of the disclosure is defined not by the detailed description of the disclosure but by the appended claims, and all differences, variations and modifications within the scope will be construed as being included in the present disclosure concepts or prospects of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dust collector to collect charged particles, comprising:

a first electrode to which a voltage is applied, the first electrode being formed of a semiconductive polymer that includes a thermoplastic polymer and an inherently dissipative polymer; and a second electrode that is grounded and generates an electric field with the first electrode to collect the charged particle, wherein the thermoplastic polymer includes acrylonitrile butadiene styrene (ABS), wherein the inherently dissipative polymer includes polyamide 6 (PA6), wherein the first electrode contains 10 wt % to 20 wt % of PA6 as the inherently dissipative polymer, and wherein a surface resistivity of the first electrode is in a range of $10^{10}$ Ω/sq to $10^{11}$ Ω/sq.

2. The dust collector according to claim 1, further comprising:

a terminal formed of a metal material and electrically connected to an external power source, the terminal applying the voltage to the first electrode.

3. The dust collector according to claim 1, wherein the first electrode includes:

a plurality of high voltage plates disposed in parallel of each other, and a high voltage rib which connects the plurality of high voltage plates.

4. The dust collector according to claim 3, wherein the second electrode includes:

a plurality of ground plates disposed in parallel of each other and the plurality of high voltage plates, and a ground rib which connects the plurality of ground plates.

5. An electric dust collector comprising:

an electrifier that charges a suspended particle, a dust collector that generates an electric field to collect the charged particle, and a case accommodating the electrifier and the dust collector, wherein the dust collector includes:

a first electrode to which a voltage is applied, the first electrode being formed of a semiconductive polymer that includes a thermoplastic polymer and an inherently dissipative polymer; and a second electrode that is grounded and generates the electric field with the first electrode to collect the charged particles, wherein the thermoplastic polymer includes acrylonitrile butadiene styrene (ABS), wherein the inherently dissipative polymer includes polyamide 6 (PA6), wherein the first electrode contains 10 wt % to 20 wt % of PA6 as the inherently dissipative polymer, and wherein a surface resistivity of the first electrode is in a range of $10^{10}$ Ω/sq to $10^{11}$ Ω/sq.

6. The electric dust collector according to claim 5, further comprising:

a terminal formed of a metal material and electrically connected to an external power source, the terminal applying the voltage to the first electrode.

7. The electric dust collector according to claim 5, wherein the first electrode includes:

a plurality of high voltage plates disposed in parallel of each other, and a high voltage rib which connects the plurality of high voltage plates.

8. The electric dust collector according to claim 7, wherein the second electrode includes:

a plurality of ground plates disposed in parallel of each other and the plurality of high voltage plates, and a ground rib which connects the plurality of ground plates.

* * * * *